United States Patent [19]

Goettel

[11] Patent Number: 4,721,486

[45] Date of Patent: Jan. 26, 1988

[54] AUTOMATIC MARKER BUOY RELEASE MECHANISM

[76] Inventor: Robert J. Goettel, 8101 W. Montebello Ave., Glendale, Ariz. 85303

[21] Appl. No.: 894,569

[22] Filed: Aug. 8, 1986

[51] Int. Cl.[4] ..... B63B 22/00

[52] U.S. Cl. ..... 441/6; 441/10; 441/26; 251/294

[58] Field of Search ..... 441/6, 7, 9, 10, 23, 441/24, 25, 26, 27, 30, 41, 42, 93, 94; 251/294; 200/83 R, 83 A, 83 C

[56] References Cited

U.S. PATENT DOCUMENTS

| | | | |
|---|---|---|---|
| 2,450,961 | 10/1948 | Heymann et al. | 200/83 A |
| 2,687,541 | 8/1954 | Bannister | 441/9 |
| 2,818,586 | 1/1958 | Dayer et al. | 441/10 |
| 3,955,792 | 5/1976 | Cho | 251/294 |

FOREIGN PATENT DOCUMENTS

| | | | |
|---|---|---|---|
| 632429 | 1/1928 | France | 441/24 |

*Primary Examiner*—Sherman D. Basinger
*Assistant Examiner*—Edwin L. Swinehart
*Attorney, Agent, or Firm*—Herbert E. Haynes, Jr.

[57] ABSTRACT

A marker buoy releasing mechanism for marking the location of a sunken boat includes an air tight housing having a differential pressure switch mounted therein for sensing the pressure within the housing and externally thereof. When the differential pressure sensed by the switch increases to a predetermined value, indicative of sinking of the boat, the switch will close to complete the electric circuit between a battery and an electrically operated device. When electric power is coupled through the differential pressure switch to the electrically operated device, it will be operated to actuate an inflating mechanism which supplies compressed gas to an inflatable marker buoy which floats to the surface of the water on the end of a tethering line.

20 Claims, 6 Drawing Figures

AUTOMATIC MARKER BUOY RELEASE MECHANISM

BACKGROUND OF THE INVENTION

1. Field of the Invention

This invention relates in general to flotation devices and more particularly to a positive acting mechanism for marking the location of a sunken vessel.

2. Description of the Prior Art

The problems of monetary loss, locating and salvaging operations, time delays in boat racing events, and other problems associated with boating accidents which result in vessel sinkings are well known in the art, and several types of devices have been proposed for marking the location of a sunken vessel.

A first general type of automatic marker buoy release mechanism is operated when water comes in contact with a chemical compound that generates a gas that is used for inflation of a balloon-type marker buoy. In that boats by design are operated in a wet environment, water resulting from splashing, heavy seas, and the like, must be kept away from the chemical to prevent actuation of the mechanism in the absence of actual submergence. This is usually done by providing some sort of spring biased valve for closing the chamber in which the gas generating chemical compound is contained so that water is kept away from the chemical until the vessel is submerged far enough below the water's surface to achieve enough pressure to overcome the bias of the spring.

A second general type of automatically operated marker buoy release mechanism employs a water soluble link formed of, for example, soluble thermoplastic, which releases a spring-loaded linkage mechanism to pierce a gas cylinder when the link dissolves as a result of its coming in contact with water. As was the case with the above discussed gas generating mechanism, causal water resulting from splashing, rough seas, and the like, must be kept away from the soluble link to keep the mechanism from becoming activated in the absence of vessel sinking. Keeping causal water away from the soluble link can be accomplished in various ways such as by using, for example, a spring-loaded piston which normally holds the water inlet of the mechanism closed. Upon sinking of a vessel, the piston will remain closed until water pressure acting on the piston becomes great enough to overcome the spring bias applied to the piston. When the piston is moved as a result of water pressure, it will open the water inlet to the mechanism and thus allow water to come in contact with the soluble link.

Still another general type of automatically operated marker buoy release mechanism includes a spring-loaded diaphragm, or bellows, which reacts to water pressure, of sufficient quantity to overcome the spring bias, by moving to activate buoy releasing linkage assemblies.

The above described automatically operated marker buoy release mechanisms all have problems of one sort or another. All are relatively complex mechanisms, and, as is well known, as the complexity of mechanisms per se increases, the incidence of failure also increases. Another problem, which is worse in some types of mechanism than it is in others, is the time delay between vessel sinking and deployment of the marker buoy. Time delays may not be a problem in all cases of vessel sinkings, but it certainly creates problems in cases where time is of the essence such as in boat racing events. When an accident occurs in a boat race, the race must be suspended until such time as the wreckage is cleared from the course. If locating and salvaging of a sunken racing boat takes excessive time, spectator interest will wane and the boat racing events can be delayed far beyond the scheduled time. Another problem with the prior art mechanisms discussed above is that it is possible to lose a boat in relatively shallow water and not activate the marker buoy release mechanism due to a lack of sufficient water pressure needed to overcome the spring biasing forces.

Therefore, a need exists for a new and useful automatic marker buoy release mechanism which overcomes some of the problems and shortcomings of the prior art.

SUMMARY OF THE INVENTION

In accordance with the present invention, a new and useful automatic marker buoy release mechanism is disclosed for marking the location of a submerged vessel. The marker buoy release mechanism includes an air tight housing which provides a reference pressure chamber therein. A differential pressure sensing switch is located in the reference pressure chamber for sensing both the pressure within the chamber and externally thereof. When the reference pressure and the externally sensed (ambient) pressure are within specified limits with respect to each other, the pressure switch is open, and when the pressure differential reaches a predetermined value, the switch closes.

The differential pressure switch is located in the circuit between a power supply means and an electric operating means. the electric operating means is employed to activate an inflating means which is associated with an inflatable marker buoy. When the sensed differential pressure, e.g. air pressure in the reference pressure chamber of the housing and water pressure externally of the housing, reach a predetermined differential pressure value, indicative of the sinking of the vessel upon which the marker buoy mechanism is mounted, the differential pressure switch will close and thus complete the power supply circuit to the electric operating means. Operation of the electric operating means activates the inflating means causing it to inflate the marker buoy. Inflation of the marker buoy causes it to move away from the exterior of the housing and float to the surface on the end of a tether.

In a first, and preferred, embodiment, the electric operating means is a small electric motor which, by means of a suitable gear reduction unit, exerts a pulling force on a cord which operates a lever to pierce a compressed gas cylinder. High pressure gas escaping from the pierced cylinder inflates the marker buoy causing it to float to the surface and carry the tethered line with it.

In a second embodiment, the electric operating means is in the form of a solenoid which, when actuated, releases a spring-loaded firing pin which strikes the detonator of a suitable cartridge. The projectile of the fired cartridge strikes a pin which pierces a compressed gas cylinder for inflation of the marker buoy which, as above, floats to the surface carrying the tethered line with it.

Accordingly, it is an object of the present invention to provide a new and useful automatic marker buoy release mechanism for marking the location of a sunken vessel.

Another object of the present invention is to provide a new and improved automatic marker buoy release mechanism with means for sensing differential pressure between a captive reference pressure and water pressure resulting from submergence of the carrying vessel, and operating a positive acting marker buoy inflating and releasing means upon sensing of a predetermined differential pressure.

Another object of the present invention is to provide a new and useful automatic marker buoy release mechanism of the above described character wherein the means for sensing differential pressure is a differential pressure sensing switch mounted in a power supply circuit that is connected for operation of an electric operating means which, when operated, punctures a compressed gas cylinder for inflation of an inflatable marker buoy.

Still another object of the present invention is to provide a new and useful automatic marker buoy release mechanism of the above described type wherein the electric operating means is in the form of a gear motor which is coupled by a cord means to a lever actuated gas cylinder puncturing means.

Yet another object of the present invention is to provide a new and useful automatic marker buoy release mechanism of the above described character wherein the electric operating means is in the form of a solenoid which, when actuated, releases a spring-loaded cartridge firing mechanism for puncturing the compressed gas cylinder.

The foregoing and other objects of the present invention as well as the invention itself, may be more fully understood from the following description when read in conjunction with the accompanying drawings.

DESCRIPTION OF THE PREFERRED EMBODIMENTS

Figure 1:
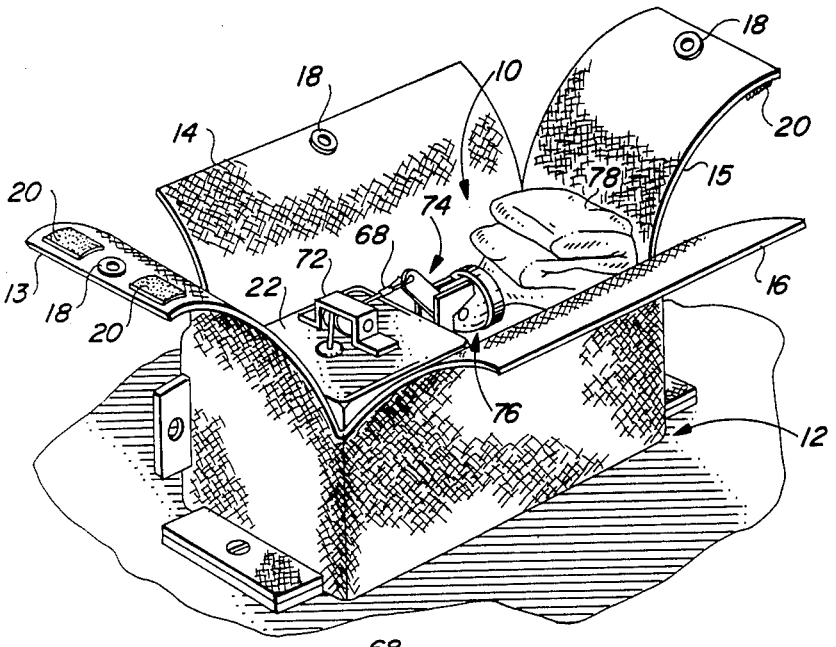
FIG. 1 is a perspective view of the automatic marker buoy release mechanism of the present invention and showing the invention as being contained in a case means.

Referring more particularly to the drawings, FIG. 1 shows the automatic marker buoy release mechanism of the present invention which is indicated generally by the reference numeral 10. The marker buoy mechanism 10 is shown in FIG. 1 as being contained within a pouch-like case 12 having an open top defined by four fold-over flaps 13, 14, 15 and 16. Three of the flaps 13, 14 and 15 are provided with suitable grommets 18 through which a looped cord (not shown) which may be carried on the fourth flap 16, is threadingly passed and locked in place, such as by a suitable pull-pin (not shown) when the marker buoy mechanism 10 is in a stored, or unarmed state. Whenever the mechanism 10 is armed, the above mentioned pull pin (not shown) is removed from the looped-cord 19 and the fold-over flaps 13, 14, 15 and 16 are held closed such as by means of suitable hook and loop fabric strips such as the illustrated Velcro strips 20 provided on the end flaps 13 and 15.

Figure 2:
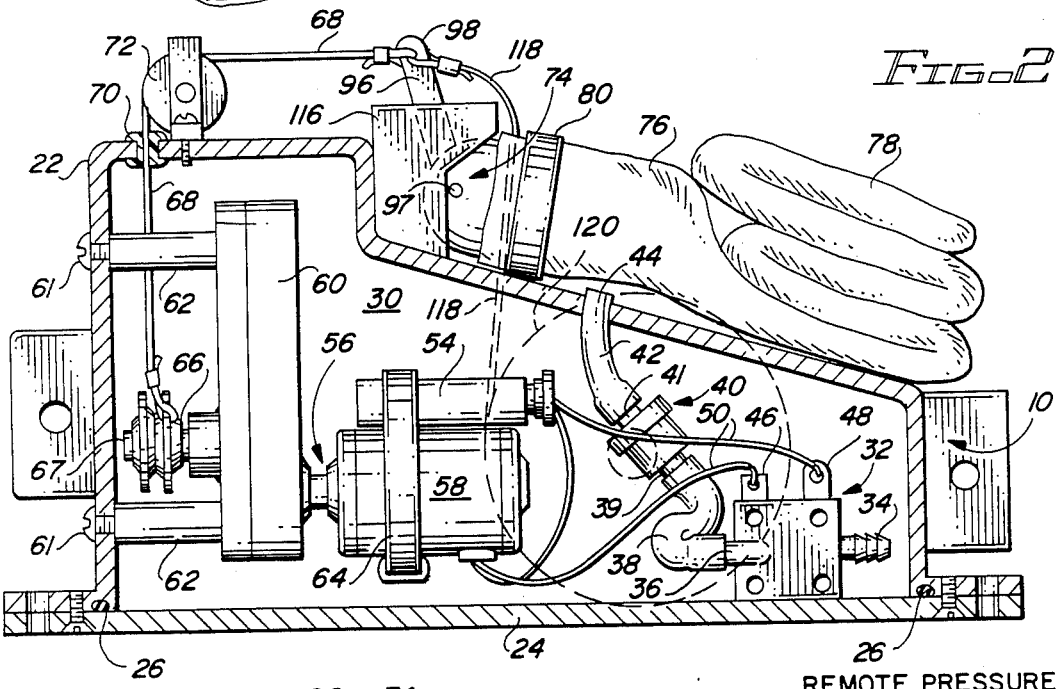
FIG. 2 is a sectional view of the automatic marker buoy release mechanism taken on a vertical plane through the mechanism.
Figure 5:
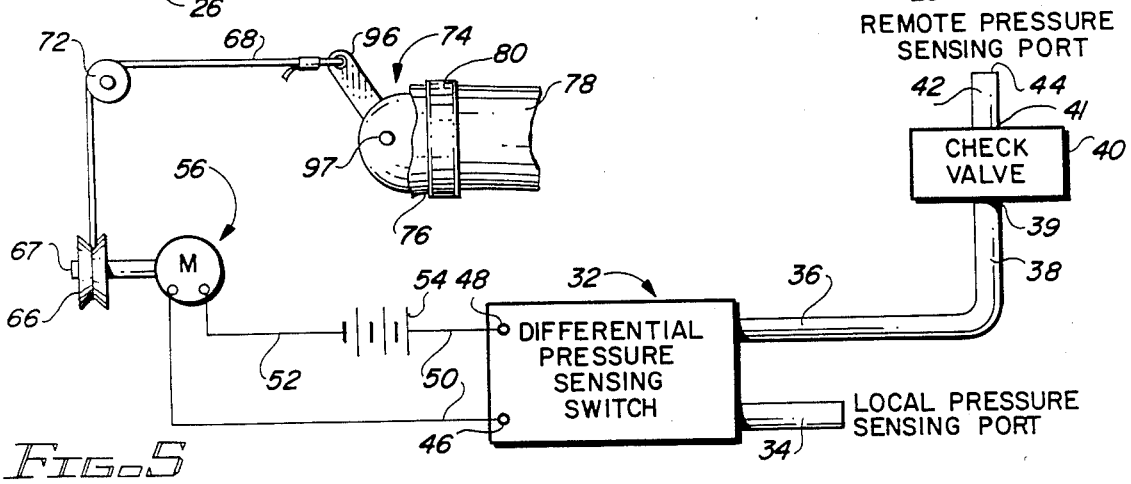
FIG. 5 is a diagrammatic view showing the operating system of the automatic marker buoy release mechanism in schematic form.

The automatic marker buoy release mechanism 10, as seen best in FIG. 2, includes a housing 22 having a removable base 24 with a suitable gasket 26 being provided between the mating flange 28 of the housing and the base so that the housing 22 and base 24 cooperatively define an air tight compartment 30.

A differential pressure sensing switch 32 is suitably mounted in the air tight compartment 30 and is provided with a low pressure sensing port 34 and a high pressure sensing port 36. The low pressure sensing port 34 is open so as to continuously sense the air pressure within the air tight compartment 30 with that pressure being referred to as the reference pressure. The high pressure port 36 of the differential pressure sensing switch 32 is coupled by means of a suitable tube 38 to one of the ports 39 of a check valve means 40. The other port 41 of the check valve means 40 has a tube 42 mounted thereon and the tube 42 has a distal end 44 which is carried in a suitable hole formed in the housing 22 so that the distal end 44 of the tube is open to the exterior of the housing 22. Thus, the differential pressure sensing switch 32 is mounted and connected so as to sense the differential pressure between the reference pressure in the compartment 30 of the housing 22 and the ambient pressure externally of the housing 22.

The check valve means 40 is a quick opening high flow capacity device which opens in response to a relatively low pressure drop thereacross. The valve means 40 is normally closed for preventing an inflow in the direction from the distal end 44 of the tube 42 toward the differential pressure sensing switch 32. This will prevent contaminating materials from entering the pressure switch 32 when normal atmospheric pressure is sensed at the distal end 44 of the tube 42. A particular check valve which has been found to be ideal for this use, is identified as a smart hose barb check valve number 302, available from Smart Pumps, Inc. 111 East Brokaw Road, San Jose, CA 95112.

The preferred differential pressure sensing switch is disclosed in U.S. Pat. No. 3,133,997, and is commercially available from World Magnetics, 810 Hastings Street, Traverse City, MI 49684. The particular model number of the preferred switch is PSF-100A-4C. The switch is available in several models which differ from each other by being actuatable from their normally open states to closed states at different pressures. The switch identified above as dash number "-4C" will be actuated at a pressure of about 7.4 mmHg and thus will be actuated to its closed state when a water head pressure, of a value achieved at between three and five feet below the water surface, is sensed at the distal end of the tube 42.

The above described differential pressure switch 32 is provided with suitable electric terminals 46 and 48 which are connected in the well known conventional manner in one of the conductive wires 50 which make up a pair of conductive wires 50 and 52 of a power supply line between a power supply means 54 and an electric operating means 56.

The power supply means 54 is shown as being a suitable battery, such as a 12 V DC battery, and the electric operating means of this embodiment of the invention is a DC gear motor.

The gear motor 56 includes a motor 58 which is mounted on and carried by a gear reduction assembly 60. The gear reduction assembly is mounted by means of suitable screws 61 and spacer sleeves 62 to the sidewall of the housing 22 as shown in FIG. 2. The above mentioned battery 54 may be mounted on the motor 58 by means of the illustrated tie strap 64. A suitable spool 66 is mounted on the output shaft 67 of the gear box assembly 60 and one end of a pull cord 68 is fixedly attached to the spool as shown. The pull cord 68 extends upwardly from the spool 66 and passes through a sealing grommet 70 mounted in a hole provided in the upper end of the housing 22. The cord 68 passes over a suitable roller means 72 and has its opposite end connected to an inflating means 74.

Figure 3:
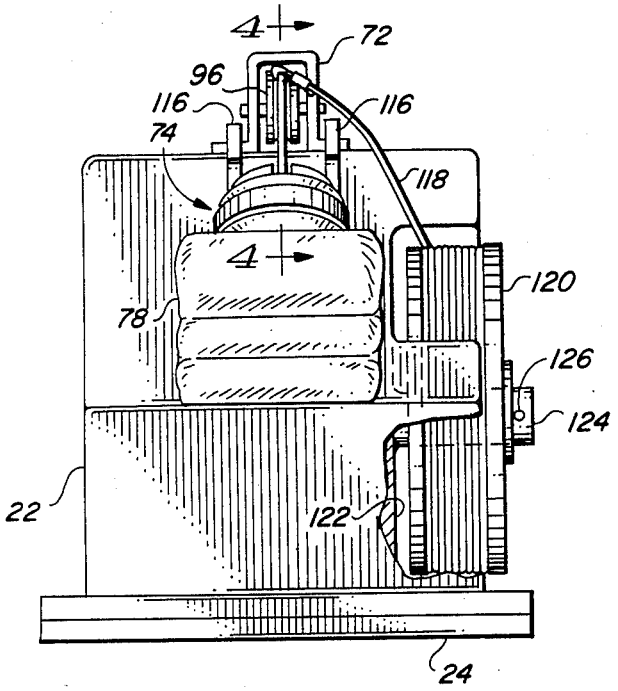
FIG. 3 is an end view of the automatic marker buoy release mechanism with portions thereof being broken away to show some of the features thereof.

The inflating means 74 is carried in the neck 76 of an inflatable marker buoy 78 which is folded over on top of the housing 22 when un-inflated as seen in FIGS. 2 and 3. The inflatable marker buoy 78 is a balloon-like elastomeric structure of the well known type, and a suitable elastomeric band 80 is employed to mount the inflating means 74 in the neck 76 thereof.

Figure 4:
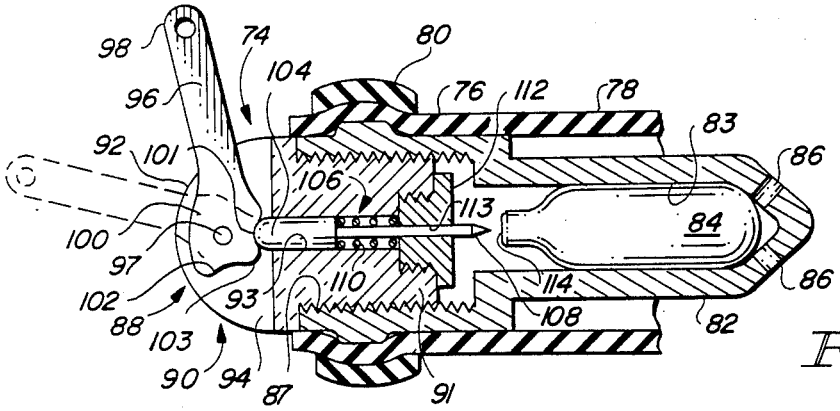
FIG. 4 is an enlarged fragmentary sectional view taken along the line 4—4 of FIG. 3.

As shown best in FIG. 4, the inflating means 74 includes a housing 82 defining a bore 83 for replaceably containing a compressed gas cylinder 84 of a well known type with the bore 83 of the housing 82 being slightly larger in diameter than the periphery of the cylinder 84. The housing 82 has openings 86 formed in the inner end thereof so that the escaping gas from the cylinder, after puncturing thereof, will flow past the periphery of the cylinder 84, through the outlet opening 86 into the interior of the inflatable marker buoy 78. The opposite end of the housing 82 is counterbored as at 87 and has internal threads for mounting of a cylinder puncturing mechanism 88 in the counterbored end 87 of the housing.

The cylinder puncturing mechanism 88 includes a special fitting 90 having an externally threaded body 91 with an enlarged head 92 and an axial bore 93. The enlarged head 92 is of dome-shaped configuration with a cross-slot 94 therein and an actuating lever 96 is mounted in the cross-slot 94 on a pivot pin 97. The actuating lever 96 has a suitable hole formed through its extending end 98 and the hereinbefore mentioned pull cord 68 is attached thereto as shown in FIG. 2. The opposite or inner end 100 of the actuating lever 96 is configured to define a cam surface having first and second depressions 101 and 102 separated by a lobe 103. In the non-actuated state, shown in solid lines in FIG. 4, the first depression 101 of the cam end of the lever 96 is in bearing engagement with the head 104 of a puncturing pin 106 which is axially movable in the bore 93 of fitting 90. The puncturing pin 106 has a reduced diameter needle pointed end 108 which forms a shoulder between the needle point end 108 and the head 103. A suitable spring 110 is mounted in the bore 93 of the fitting 90 so that one end thereof bears against the shoulder of the puncturing pin 106 so that the head 104 of the puncturing pin is in bearing engagement with the first depression 101 of the actuating lever 96. A suitable plug 112 is threadingly mounted in a counterbored end of the bore 93 of the fitting 90 at the end thereof which is opposite to the enlarged head 92 of the fitting 90. The plug 112 has a bore 113 which is coaxial with the fitting bore 93 and the needle point end 108 of the puncturing pin 106 is disposed therein.

As shown in FIG. 4, when the actuating lever 96 is in its normal non-actuated state, the distal end of the needle point end 108 of the puncturing pin 108 is disposed proximate the sealed neck 114 of the compressed gas cylinder 84. When the lever 96 is moved to its actuating state, as shown in dashed lines in FIG. 4, as a result of pulling of the cord 68, the lobe 103 will move the puncturing pin 106 into the sealed neck 114 of the gas cylinder 84 thereby piercing the seal and releasing the compressed gas. In the fully actuated state of the lever 96, the puncturing pin 106 will be extracted from the neck 114 by the spring 110 and the head 104 of the pin will be in bearing engagement with the second depression 102 of the cam end 100 of the puncturing pin 106.

The compressed gas released from the cylinder 84 in the manner described above, will enter the interior of the inflatable marker buoy 78 through the holes 86 formed in the inner end of the housing 82. The expanding marker buoy 78 will lift itself, due to buoyancy, off of the housing 22 and disengage the extending end of the inflating means 74 from the hold down brackets 116 provided on the top surface of the housing 22.

As seen best in FIGS. 2 and 3, a tether line 118 is connected to the inflating means 74, such as by being connected to the hole provided in the extending end 98 of the actuating lever 96. The tether line 118 is wound on a suitable reel 120 which is carried on the housing 22 and thus has one end connected to the inflatable marker boy 78 and its other end coupled to the housing 22 of the mechanism 10. As the inflated marker buoy 78 floats to the surface, it will unwind the tether line 118 in a well known manner.

As shown in FIG. 3, the housing 22 is provided with a recess, or cavity 122 in one side thereof for containment of the reel 120. A stud-like axle 124 is welded or otherwise fixed to the housing 22 so as to be disposed in the recess 122 thereof. The reel 120 is rotatably carried on the axle 124 and is kept from moving axially off the axle 124 by a fastener means 126 such as the illustrated washer and roll pin.

As described above, inflation of the marker buoy 78 is initiated by a pulling action of the pull cord 68 which moves the actuating lever 96 to its actuated state. Immediately after this, the pull cord 68 will be broken so as to free the inflating marker buoy thereby allowing it to float to the surface. Breaking of the pull cord 68 is accomplished by the continuing operation of the gear motor 56. To insure breakage of the pull cord 68, a thirty pound line is employed and the torque of the DC motor is above the breaking point of the pull cord. A particular gear motor which has been found to be suitable for this purpose is available from W. W. Granger, Inc., 5959 West Howard St., Chicago, IL 60648, and is identified as a Dayton Motor, Stock No. 4Z835. The full load torque in inch/pounds of this particular motor is 38, the tensile strength of the pull cord 68 is 30 pounds and the force required to puncture the sealed neck 114 of the compressed gas cylinder 84 is in the range of from 7–15 pounds.

Figure 6:
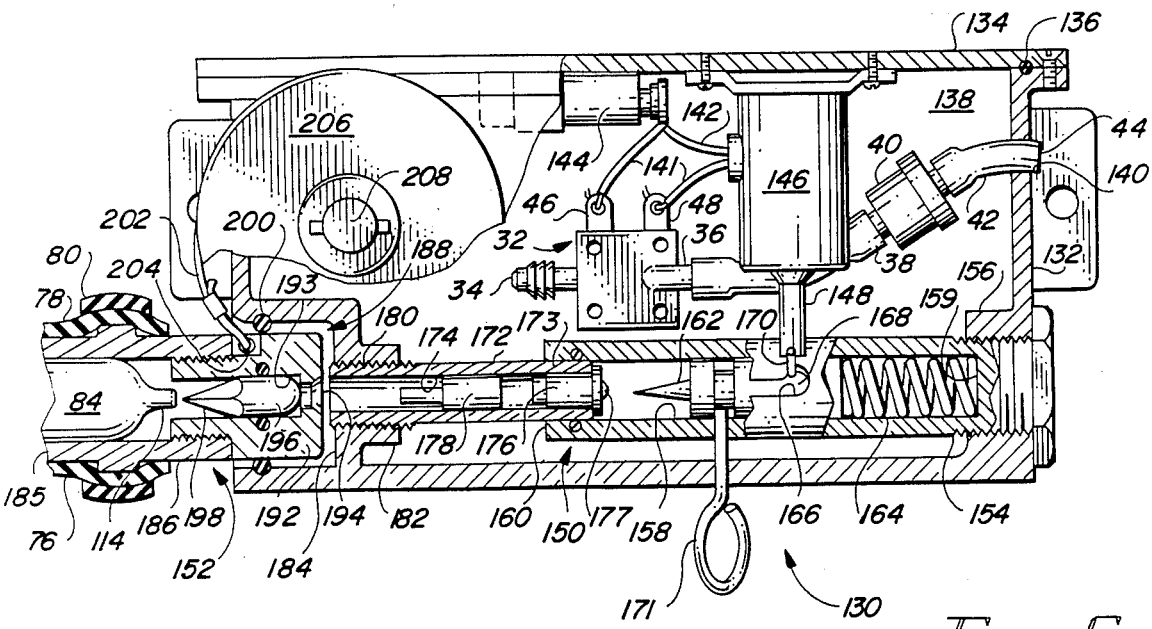
FIG. 6 is a sectional view taken on a vertical plane through a modified form of the automatic marker buoy release mechanism of the present invention.

Reference is now made to FIG. 6, wherein a second embodiment of the automatic marker buoy release mechanism of the present invention is indicated in its entirety by the reference numeral 130. The automatic marker buoy release mechanism 130 includes a housing 132 having a removable cover 134 with a suitable gasket 136 being provided between the housing and cover to form an air tight compartment 138.

The hereinbefore described differential pressure switch 32 is mounted in the air tight compartment 138 with its low pressure sensing port 34 being open to sense the pressure in the housing 132. The high pressure sensing port 36 of the differential pressure switch 32 is coupled by tube 38 to the check valve means 40 and the tube 42 has its distal end 44 carried in a suitable opening 140 formed in the housing 132. In this manner, the low pressure sensing port 34 senses internal pressure of the housing 132 and the high pressure sensing port 36 senses ambient pressure, e.g. water head pressure, externally of the mechanism 130. Therefore, the switch 32 will be actuated from its normally open state to its closed state when the differential pressure sensed thereby reaches the predetermined value as hereinbefore described.

The differential pressure switch 32 in this embodiment, has its terminals 46 and 48 suitably mounted in the power supply lines 141 and 142 which connect the battery 144, or other suitable source of electric power, to an electric operating means 146.

The electric operating means 146 of this embodiment of the present invention is in the form of a solenoid having an extensible plunger 148 which is retracted in the de-energized normal state of the solenoid. As will hereinafter be described, the solenoid 146 acts like a triggering mechanism for operation of a projectile moving means, or firing device 150 which, in turn, operates an inflating mechanism 152.

The projectile moving means, or firing device 150 includes a body 154 which is threadingly carried in a suitable boss 156 of the housing 132, so as to be demountable for loading and arming purposes as will become apparent as this description progresses. The body 154 defines an axial bore 158 which is closed at one end 159 thereof and is open at its opposite end 160. A firing pin 162 is mounted for axial movement in the bore 158 and is biased toward the open end 160 of the bore by means of a suitable compression spring 164. The body 154 is formed with an axially extending slot 166 which opens laterally of the bore 158 and has an offset notch 168 at the closed end thereof. The firing pin 162 has a latching pin 170 which extends radially therefrom and is disposed to extend through the lateral slot 166 of the body 154. When the firing pin 162 is moved toward the closed end 159 of the axial bore 158 and rotated, the latching pin 170 will move into the offset notch 168 to hold the firing pin 162 in the armed position, as shown, against the bias applied thereon by the spring 164. As shown, a safety pin 171 is demountably positioned so as to extend through the housing 132 and the body 154 to lock the firing pin in its armed state.

When the solenoid 146 is in its normal state, its retracted plunger 148 will be proximate the latching pin 170 when that pin is located in the offset notch 168 of the body 154. When the solenoid is actuated, in the manner described above, the plunger 148 will move to the extended position and in doing so, will push the latching pin 170 out of the offset notch 168 into the axial slot 166 of the body 154. When the firing pin 162 is freed in this manner, the spring 164 will move the firing pin toward the open end 160 of the body 154.

A tube 172 has one of its ends 173 demountably carried in the open end 160 of the bore 158 of the body 154 and the tube 172 defines a bore 174 which is coaxial with the bore 158 of the body 154. The end 173 of the tube 172 is configured to receive a blank cartridge 176 which is mounted therein so that its primer 177 is disposed for impacting by the firing pin 162 upon actuation of the solenoid 146. A projectile 178 is slidably carried in the bore 174 of the tube 172 and will be propelled toward the opposite end 180 of the tube 172 by expanding gasses when the blank cartridge 176 is fired. The opposite end 180 of the tube 172 is threadingly carried in a boss 182 formed in the housing 132 so as to open into a cavity 184 formed in the side of the housing 132.

The previously mentioned inflating means 152, which is carried in the neck 76 of the inflatable marker buoy 78 by means of the elastomeric band 80 in the same manner as the previously described inflating means 74, is frictionally and demountably carried in the cavity 184 of the housing 132 as will hereinafter be described. The inflating means 152 includes a housing 185 of the same basic type as the housing 82 of the hereinbefore described inflating means 74, for containment of the compressed gas cylinder 84. The housing 185 has one end (not shown) which is inwardly disposed within the neck 76 of the inflatable marker buoy 78, which has a plurality of openings (not shown) of the type described with reference to the inflating means 74, for directing compressed gas from the cylinder 84 into the interior of the inflatable marker buoy 78. The outwardly disposed end 186 of the housing 185 is internally threaded for mounting of a cylinder piercing mechanism 188 therein.

The cylinder piercing mechanism 188 includes a special fitting 190 having an externally threaded body with an enlarged head 192 and an axial bore 193. The fitting 190 is configured so that its bore 193 has a reduced diameter end 194 for receiving the projectile 178 when it is propelled along the bore 158 of the tube 172 by firing of the blank cartridge 176. A puncturing pin 196 is slidably carried in the increased diameter end of the axial bore 193 of the fitting 190 so as to be disposed for impacting by the projectile 178 upon receipt thereof in the reduced diameter end 194 of the fitting's bore 193. The puncturing pin 196 has a pointed end 198 which is disposed proximate the sealed neck 114 of the compressed gas cylinder 84 so that the pointed end 198 will pierce the sealed neck and thereby release gas into the inflatable marker buoy 78 when the puncturing pin 196 is impacted by the projectile 178.

As shown, the enlarged head 192 of the special fitting 190 is located in the cavity 184 of the housing 132 and is releasibly held therein by an O-ring 200 which is carried in the cavity so as to frictionally grip the enlarged head 192. When the inflatable marker buoy 78 receives gas from the pierced cylinder 84, its increasing buoyancy will cause it to pull the enlarged head 192 of the fitting 190 out of the cavity 184 of the housing 132 as it starts moving toward the surface of the water in which it is submerged.

A tether line 202 is connected to the inflatable marker buoy 78, such as by being connected to a suitable hole 204 provided in the head 192 of the fitting 190 of the inflating means 152. The tether line 202 is secured to and wound around a reel 206 which is rotatably carried on a stud-like axle 208 which is mounted on the housing 132.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A self-contained marker buoy release mechanism for marking the location of a submerged boat comprising:

(a) a housing for mounting on the boat, said housing defining an air tight interior compartment;

(b) an inflatable marker buoy releasably carried on the exterior of said housing;

(c) means connected between the exterior of said housing and said marker buoy for tethering said marker buoy to said housing;

(d) inflating means including a supply of compressed gas, said inflating means being coupled to said inflatable marker buoy and being actuatable for supplying the compressed gas to said inflatable marker buoy for inflation thereof;

(e) electric power supply means;

(f) electric operating means coupled to said inflating means and being operable for actuating said inflating means;

(g) circuit means connected between said power supply means and said electric operating means; and (h) a normally open differential pressure switch for sensing the differential pressure between the interior compartment of said housing and the exterior thereof, said differential pressure switch being electrically mounted in said circuit means for holding said circuit means open when the sensed differential pressure is below a predetermined value and completing said circuit means when the sensed differential pressure exceeds the predetermined value.

2. A marker buoy release mechanism as claimed in claim 1 and further comprising:

(a) said inflatable marker buoy including an elastomeric body defining an interior and having a neck in communication with the interior thereof; and (b) said inflating means being demountably mounted in the neck of said inflatable marker buoy and including, I. a housing defining a bore, said housing having opposed ends one of which has a plurality of holes formed therethrough which place the bore of said housing in communication with the interior of the elastomeric body of said inflatable marker buoy, II. a sealed compressed gas cylinder in the bore of said housing, III. cylinder puncturing means mounted in the opposite end of said housing, said cylinder puncturing means being disposed for actuation by said electric operating means to pierce said sealed compressed gas cylinder so that gas escaping therefrom will enter the interior of said elastomeric body of said inflatable marker buoy.

3. A marker buoy release mechanism as claimed in claim 1 wherein said means connected between said housing and said marker buoy comprises:

(a) an axle mounted on the exterior of said housing;

(b) a reel rotatably carried on said axle; and (c) a tether line wound on said reel and having one end coupled to said inflatable marker buoy.

4. A marker buoy release mechanism as claimed in claim 1 wherein said electric power supply means is in the form of an electric storage battery which is mounted in the air tight compartment of said housing.

5. A marker buoy release mechanism as claimed in claim 1 and further comprising:

(a) said inflatable marker buoy including an elastomeric body defining an interior and having a neck in communication with the interior thereof; and (b) said inflating means being demountably mounted in the neck of said inflatable marker buoy and including, I. a housing defining a bore, said housing having opposite ends one of which is in communication with the interior of said inflatable marker buoy, II. A sealed compressed gas cylinder in the bore of said housing, III. cylinder puncturing means mounted in the other end of said housing and having a lever means for actuating said cylinder puncturing means to pierce said sealed compressed gas cylinder so that gas escaping therefrom will enter into the interior of the elastomeric body of said inflatable marker buoy.

6. A marker buoy release mechanism as claimed in claim 5 wherein said electric operating means comprises:

(a) an electric gear motor coupled to said circuit means and mounted in the air tight compartment of said housing and having an output shaft;

(b) spool means mounted for rotation with the output shaft of said electric gear motor; and (c) a pull cord having one end attached to said spool means, said pull cord extending from said air tight compartment of said housing and having its opposite end attached to said lever means of said cylinder puncturing means for actuating said cylinder puncturing means when said spool means is rotatably driven by said electric gear motor.

7. A marker buoy release mechanism as claimed in claim 1 and further comprising:

(a) said inflating means having a lever means which is movable to an actuated position for actuating of said inflating means; and (b) said electric operating means comprising, I. an electric gear motor coupled to said circuit means and having an output shaft, II. spool means mounted on the output shaft of said electric gear motor for rotation therewith, III. a pull cord having one end connected to said spool means and the other end connected to said lever means of said inflating means for moving said lever means to its actuated position upon operation of said electric gear motor.

8. A marker buoy release mechanism as claimed in claim 7 wherein the torque of said electric gear motor is greater than the tensile strength of said pull cord so that said pull cord will be broken subsequent to its having moved said lever means of said inflating means to its actuated position.

9. A marker buoy release mechanism as claimed in claim 1 and further comprising:

(a) said inflatable marker buoy including an elastomeric body defining an interior and having a neck in communication with the interior thereof; and (b) said inflating means being demountably mounted in the neck of said inflatable marker buoy and including, I. a housing defining a bore, said housing having opposite ends one of which is in communication with the interior of said inflatable marker buoy, II. a sealed compressed gas cylinder in the bore of said housing, III. cylinder puncturing means mounted in the other end of said housing and having an impactingly operable puncturing pin for movement into piercing engagement with said sealed compressed gas cylinder so that when said puncturing pin is impactingly moved into piercing engagement with said sealed compressed gas cylinder, escaping gas will enter into the interior of said inflatable marker buoy.

10. A marker buoy release mechanism as claimed in claim 9 wherein said electric operating means comprises:

(a) a projectile means for movement into impacting operating engagement with said puncturing pin of said inflating means;

(b) a projectile moving means having an armed state with means for being biasingly moved from the armed state to a fired state to cause movement of said projectile means into impacting operating engagement with said projectile means upon being biasingly moved to its fired state;

(c) latching means for releasibly holding said projectile moving means in the armed state thereof; and (d) a solenoid coupled to said circuit means and having a normally retracted extensible plunger which moves into releasing engagement with said latching means upon actuation of said solenoid.

11. A marker buoy release mechanism as claimed in claim 10 wherein said projectile moving means comprises:

(a) a body defining a bore having an open end;

(b) a firing pin slidably movable in the bore of said buoy;

(c) biasing means in the bore of said body for urging said firing pin toward the open end of the bore of said body;

(d) a tube defining an axial bore and having a first end mounted in the open end of the bore of said body and having a second end alignigly proximate said puncturing pin of said inflating means; and (e) a blank cartridge in the first end of said tube for firing upon being impacted by said firing pin.

12. A marker buoy release mechanism as claimed in claim 11 wherein said projectile means is mounted in the bore of said tube for movement toward the second end thereof upon firing of said blank cartridge.

13. A marker buoy release mechanism as claimed in claim 11 wherein said latching means is formed in said body and on said firing pin for releasibly holding said firing pin away from the open end of the bore of said body against the bias applied thereto by said biasing means.

14. A marker buoy release mechanism as claimed in claim 11 wherein said latching means comprises:

(a) said body defining a slot having a closed end and disposed to extend from the closed end thereof axially along said body toward the open end of the bore defined thereby;

(b) said body further defining an offset notch which is in open communication with the closed end of the slot defined by said body; and (c) a pin extending radially from said firing pin through the offset notch of said body for releasibly holding said firing pin away from the open end of the bore defined by said body against the bias applied thereon by said biasing means, said pin being movable out of the offset notch of said body upon actuation of said solenoid for releasing said firing pin for movement toward the open end of the bore defined by said body.

15. A marker buoy release mechanism as claimed in claim 1 wherein said differential pressure switch comprises:

(a) a low pressure sensing port which opens into the air tight compartment of said housing;

(b) a high pressure sensing port; and (c) means for coupling said high pressure sensing port to a point external of said housing.

16. A marker buoy release mechanism as claimed in claim 15 wherein said means for coupling comprises:

(a) a tube extending from said high pressure sensing port through a sidewall of said housing; and (b) a normally closed check valve in said tube, said check valve being actuatable to an open state when the sensed pressure externally of said housing reaches a predetermined value.

17. A marker buoy release mechanism for marking the location of a submerged boat comprising:

(a) a housing for mounting on a boat, said housing defining an air tight interior compartment;

(b) an inflatable marker buoy releasibly carried on the exterior of said housing;

(c) an elongated tethering line connected between said inflatable marker buoy and said housing;

(d) inflating means coupled to said inflatable marker buoy and including an actuating lever;

(e) an electric storage battery;

(f) an electric gear motor mounted in the compartment of said housing and having an output shaft;

(g) circuit means interconnecting said battery and said gear motor;

(h) spool means on the output shaft of said gear motor for rotation therewith;

(i) a pull cord having one end attached to said spool and its other end attached to the actuating lever of said inflating means; and (j) a normally open differential pressure switch mounted in the compartment of said housing, said pressure switch having a low pressure sensing port which opens into the compartment of said housing and having a high pressure sensing port with means for coupling thereof to a point external of said housing, said pressure switch being electrically mounted in said circuit means for opening thereof when the sensed differential pressure is below a predetermined value and closing said circuit means when the sensed differential pressure exceeds the predetermined value.

18. A marker buoy release mechanism as claimed in claim 17 wherein said electric gear motor has a fully loaded torque value which is in excess of the tensile strength of said pull cord for breaking said pull cord subsequent to actuation of said inflating means.

19. A marker buoy release mechanism for marking the location of a submerged boat comprising:

(a) a housing for mounting on a boat, said housing defining an air tight compartment;

(b) an inflatable marker buoy releasibly carried on the exterior of said housing;

(c) an elongated tethering line connected between said housing and said inflatable marker buoy;

(d) inflating means coupled to said inflatable marker buoy and including an actuating pin;
(e) an electric storage battery;
(f) circuit means connected to said battery;
(g) projectile means for movement into operating engagement with the actuating pin of said inflating means;
(h) projectile moving means having an armed state with means for being biasingly moved from the armed state to a fired state to move said projectile means into operating engagement with the actuating pin of said inflating means;
(i) latching means for releasibly holding said projectile moving means in the armed state thereof;
(j) a solenoid having a normally retracted extensible plunger which moves into releasing engagement with said latching means upon actuation of said solenoid, said solenoid being electrically connected to said circuit means; and
(k) a normally open differential pressure switch in the compartment of said housing, said pressure switch having a low pressure sensing port which opens into the compartment of said housing and having a high pressure sensing port with means for coupling thereof to a point external of said housing, said pressure switch being electrically mounted in said circuit means for opening thereof when the sensed differential pressure is below a predetermined value and for completing said circuit means when the sensed differential pressure exceeds that predetermined value.

20. A marker buoy release mechanism as claimed in claim 19 and further comprising:
(a) a projectile moving means includes,
I. a body defining a bore and having an open end,
II. a firing pin slidably movable in the bore of said body,
III. biasing means in the bore of said body for urging said firing pin toward the open end of the bore of said body,
IV. a tube defining an axial bore and having a first end mounted in the open end of the bore of said body and having a second end aligningly proximate the actuating pin of said inflating means,
V. a blank cartridge in the first end of said tube for firing upon being impacted by said firing pin;
(b) said projectile means being mounted in the bore of said tube for movement toward the second end thereof upon firing of said blank cartridge; and
(c) said latching means is formed in said body and on said firing pin for releasibly holding said firing pin away from the open end of the bore of said body against the bias applied thereto by said biasing means.

* * * * *